US009156579B2

(12) United States Patent
Pinkstone

(10) Patent No.: US 9,156,579 B2
(45) Date of Patent: Oct. 13, 2015

(54) CARTON WITH RECLOSEABLE FEATURES

(71) Applicant: Graphic Packaging International, Inc., Atlanta, GA (US)

(72) Inventor: Felicia A. Pinkstone, Aston, PA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/325,609

(22) Filed: Jul. 8, 2014

(65) Prior Publication Data

US 2015/0014402 A1 Jan. 15, 2015

Related U.S. Application Data

(60) Provisional application No. 61/957,651, filed on Jul. 9, 2013.

(51) Int. Cl.

| | |
|---|---|
| ***B65D 5/355*** | (2006.01) |
| ***B65D 5/66*** | (2006.01) |
| ***B31B 1/74*** | (2006.01) |
| ***B65D 5/42*** | (2006.01) |
| ***B65D 5/54*** | (2006.01) |

(52) U.S. Cl.

CPC ..... *B65D 5/0005* (2013.01); *B31B 1/74* (2013.01); *B65D 5/4204* (2013.01); *B65D 5/5445* (2013.01); *B65D 5/66* (2013.01)

(58) Field of Classification Search

USPC ..... 229/101.2, 221, 125.08, 120.09, 229/120.03; 206/774; 221/32

See application file for complete search history.

(56) References Cited

U.S. PATENT DOCUMENTS

| | | | |
|---|---|---|---|
| 1,772,625 | A | 8/1930 | Caulfield |
| 2,139,021 | A | 12/1938 | Johnson |
| 2,192,722 | A | 3/1940 | Vogt |
| 2,251,283 | A | 8/1941 | Johnson |
| 2,292,573 | A | 8/1942 | Kondolf |
| 2,335,913 | A | 12/1943 | Buttery |
| 2,337,892 | A | 12/1943 | Hultin |
| 2,345,486 | A | 3/1944 | Nathan |
| 2,355,665 | A | 8/1944 | Mabee |
| 2,365,159 | A | 12/1944 | Walton et al. |
| 2,396,310 | A | 3/1946 | Gibson |
| 2,437,926 | A | 3/1948 | Ball et al. |

(Continued)

FOREIGN PATENT DOCUMENTS

| | | |
|---|---|---|
| DE | 29 23 455 A1 | 12/1980 |
| DE | 81 10 323.9 | 9/1981 |

(Continued)

*Primary Examiner* — Christopher Demeree

(74) *Attorney, Agent, or Firm* — Womble Carlyle Sandridge & Rice, LLP

(57) ABSTRACT

A carton for holding a product. The carton having a plurality of panels that extends at least partially around an interior of the carton, the plurality of panels comprises a front panel, a back panel, a first side panel and a second side panel. A tear away panel in at least one of the plurality of panels, the tear away panel providing access to the interior. A hinge in at least one of the plurality of panels and at least one tear line extending at least partially across at least one of the plurality of panels. The at least one tear line dividing the carton into a first portion and a second portion. The first portion configured to be pivotable at the hinge between an open position allowing access to the interior and a closed position with the first portion at least partially overlapping the second portion.

37 Claims, 12 Drawing Sheets

(56) References Cited

U.S. PATENT DOCUMENTS

| | | | |
|---|---|---|---|
| 2,475,677 | A | 7/1949 | Ringler |
| 2,509,289 | A | 5/1950 | Dunning |
| 2,594,394 | A | 4/1952 | Cassekman et al. |
| 2,973,086 | A | 2/1961 | Thompson |
| 3,013,712 | A | 12/1961 | Wollaeger |
| 3,021,002 | A | 2/1962 | Guyer |
| 3,033,362 | A | 5/1962 | Marcalus |
| 3,133,688 | A | 5/1964 | Asman |
| 3,180,556 | A | 4/1965 | Asman |
| 3,302,847 | A | 2/1967 | Hennessey |
| 3,347,446 | A | 10/1967 | Reynolds et al. |
| 3,355,089 | A | 11/1967 | Champlin |
| 3,363,822 | A | 1/1968 | Maulini et al. |
| 3,426,955 | A | 2/1969 | Olson |
| 3,426,956 | A | 2/1969 | Frohlicher |
| 3,486,682 | A | 12/1969 | Whipperman |
| 3,578,234 | A | 5/1971 | Marchisen |
| 3,669,345 | A | 6/1972 | Cole |
| 3,680,766 | A | 8/1972 | Collura et al. |
| 3,690,544 | A | 9/1972 | Meyers |
| 3,744,702 | A | 7/1973 | Ellison |
| 3,768,719 | A | 10/1973 | Johnson |
| 4,262,816 | A | 4/1981 | Margulies |
| 4,344,537 | A | 8/1982 | Austin |
| 4,484,683 | A | 11/1984 | Werner, Jr. |
| 4,508,218 | A | 4/1985 | Focke et al. |
| 4,512,476 | A | 4/1985 | Herrington, Jr. |
| 4,558,785 | A | 12/1985 | Gordon |
| 4,572,423 | A | 2/1986 | Spencer |
| 4,584,202 | A | 4/1986 | Roccaforte |
| 4,621,736 | A | 11/1986 | Roccaforte |
| 4,645,108 | A | 2/1987 | Gavin et al. |
| 4,676,394 | A | 6/1987 | Hiersteiner |
| 4,746,019 | A | 5/1988 | Prater |
| 4,768,703 | A | 9/1988 | Sosler et al. |
| 4,771,936 | A | 9/1988 | Dolby |
| 4,863,052 | A | 9/1989 | Lambert |
| 4,905,898 | A | 3/1990 | Wade |
| 4,948,038 | A | 8/1990 | Moeller |
| 5,105,971 | A | 4/1992 | Hertenstein et al. |
| 5,265,799 | A | 11/1993 | Stone |
| 5,292,058 | A | 3/1994 | Zoss et al. |
| 5,347,865 | A | 9/1994 | Mulry et al. |
| 5,356,022 | A | 10/1994 | Tipps |
| 5,363,981 | A | 11/1994 | Giblin et al. |
| 5,402,933 | A | 4/1995 | Behrmann |
| 5,427,267 | A | 6/1995 | Willman |
| 5,632,402 | A | 5/1997 | Walsh et al. |
| 5,632,404 | A | 5/1997 | Walsh |
| 5,746,871 | A | 5/1998 | Walsh |
| 5,783,030 | A | 7/1998 | Walsh |
| 5,794,811 | A | 8/1998 | Walsh |
| 5,794,812 | A | 8/1998 | Walsh |
| 5,857,614 | A | 1/1999 | Walsh |
| 5,911,359 | A | 6/1999 | Stone et al. |
| 5,918,799 | A | 7/1999 | Walsh |
| 5,960,555 | A | 10/1999 | Deaton et al. |
| 5,996,797 | A | 12/1999 | Flaig |
| 6,050,484 | A | 4/2000 | Galomb |
| 6,062,467 | A | 5/2000 | Ours et al. |
| 6,102,277 | A | 8/2000 | Krapohl, Sr. |
| 6,145,736 | A | 11/2000 | Ours et al. |
| 6,206,279 | B1 | 3/2001 | Countee |
| 6,352,096 | B1 | 3/2002 | Walsh |
| 6,364,202 | B1 | 4/2002 | Zelley |
| 6,386,438 | B1 | 5/2002 | Walsh et al. |
| 6,419,151 | B1 | 7/2002 | Urtubey |
| 6,520,404 | B1 | 2/2003 | Waldburger et al. |
| 6,568,586 | B1 | 5/2003 | VanEsley et al. |
| 6,761,269 | B2 | 7/2004 | Hamming |
| 6,854,639 | B2 | 2/2005 | Walsh |
| 6,869,009 | B2 | 3/2005 | Sutherland et al. |
| 6,913,190 | B2 | 7/2005 | Ruhbusch et al. |
| 7,025,504 | B2 | 4/2006 | Olin |
| 7,036,714 | B2 | 5/2006 | Walsh et al. |
| 7,210,612 | B2 | 5/2007 | Walsh et a |
| 7,306,135 | B2 | 12/2007 | DeBusk et al. |
| 7,407,087 | B2 | 8/2008 | DeBusk et al. |
| 7,503,475 | B2 | 3/2009 | McGowan |
| D597,835 | S | 8/2009 | Kwon et al. |
| 7,699,214 | B2 | 4/2010 | Mestre et al. |
| 7,703,665 | B2 | 4/2010 | McGowan |
| 7,913,897 | B2 | 3/2011 | Manaige |
| 7,959,060 | B2 | 6/2011 | Wilson et al. |
| 8,002,171 | B2 | 8/2011 | Ryan et al. |
| 8,061,585 | B2 | 11/2011 | Nikolai et al. |
| 8,672,214 | B2 | 3/2014 | Manaige |
| 2001/0048022 | A1 | 12/2001 | Zoeckler |
| 2002/0036153 | A1 | 3/2002 | Yang |
| 2002/0055429 | A1 | 5/2002 | Walsh |
| 2003/0144121 | A1 | 7/2003 | Walsh et al. |
| 2004/0007614 | A1 | 1/2004 | Saulas |
| 2004/0226989 | A1 | 11/2004 | Cook et al. |
| 2005/0109827 | A1 | 5/2005 | Martin |
| 2005/0127150 | A1 | 6/2005 | Walsh et al. |
| 2005/0187087 | A1 | 8/2005 | Walsh |
| 2005/0274782 | A1 | 12/2005 | Petrelli et al. |
| 2006/0049067 | A1 | 3/2006 | McDonald |
| 2006/0054675 | A1 | 3/2006 | Bennett |
| 2006/0243783 | A1 | 11/2006 | Spivey et al. |
| 2006/0255105 | A1 | 11/2006 | Sweet |
| 2006/0255107 | A1 | 11/2006 | Wright |
| 2006/0266810 | A1 | 11/2006 | Foushee |
| 2007/0235511 | A1 | 10/2007 | Fitzwater et al. |
| 2007/0295793 | A1* | 12/2007 | Ho Fung et al. ..... 229/122.1 |
| 2009/0001145 | A1 | 1/2009 | Hasse et al. |
| 2009/0045084 | A1 | 2/2009 | Roila et al. |
| 2010/0019022 | A1 | 1/2010 | Ryan et al. |
| 2010/0102114 | A1 | 4/2010 | Pinkstone |
| 2010/0193575 | A1 | 8/2010 | Fontaine et al. |
| 2010/0288657 | A1 | 11/2010 | Pinkstone |
| 2011/0095075 | A1 | 4/2011 | Pinkstone |
| 2011/0180594 | A1* | 7/2011 | Fitzwater ..... 229/120.24 |
| 2012/0118904 | A1 | 5/2012 | Fitzwater et al. |
| 2013/0193197 | A1 | 8/2013 | Low et al. |
| 2014/0175095 | A1 | 6/2014 | Pinkstone |

FOREIGN PATENT DOCUMENTS

| | | | |
|---|---|---|---|
| DE | 87 08 078.8 | | 10/1987 |
| DE | 94 13 813 | U1 | 10/1994 |
| EP | 0 406 556 | A1 | 1/1991 |
| EP | 1 386 846 | A1 | 2/2004 |
| EP | 1 457 425 | | 9/2004 |
| FR | 2 699 150 | | 6/1994 |
| FR | 2 755 670 | | 5/1998 |
| GB | 104 445 | | 3/1917 |
| GB | 1 242 356 | | 8/1971 |
| GB | 1 489 963 | | 10/1977 |
| GB | 1 584 066 | | 2/1981 |
| GB | 2 137 172 | A | 10/1984 |
| GB | 2 363 372 | | 12/2001 |
| JP | 55 176119 | | 6/1954 |
| JP | 50-123654 | | 10/1975 |
| JP | 3 17033 | | 2/1991 |
| JP | 2010-184713 | A | 8/2010 |
| JP | 2011-084279 | A | 4/2011 |
| WO | WO 95/28325 | | 10/1995 |
| WO | WO 2006/124643 | A1 | 11/2006 |
| WO | WO 2006/133401 | | 12/2006 |

* cited by examiner

CARTON WITH RECLOSEABLE FEATURES

CROSS-REFERENCE TO RELATED APPLICATIONS

This application claims the benefit of U.S. Provisional Application No. 61/957,651, which was filed on Jul. 9, 2013.

INCORPORATION BY REFERENCE

U.S. Provisional Application No. 61/957,651, which was filed on Jul. 9, 2013, is hereby incorporated by reference for all purposes as if presented herein in its entirety.

BACKGROUND OF THE DISCLOSURE

The present disclosure generally relates to packages or cartons for holding and dispensing products, such as food products. More specifically, the present disclosure relates to cartons with recloseable features.

SUMMARY OF THE DISCLOSURE

In general, one aspect of the disclosure is generally directed to a carton for holding a product. The carton comprises a plurality of panels that extends at least partially around an interior of the carton, the plurality of panels comprises a front panel, a back panel, a first side panel and a second side panel. A tear away panel in at least one of the plurality of panels, the tear away panel providing access to the interior. A hinge in at least one of the plurality of panels and at least one tear line extending at least partially across at least one of the plurality of panels. The at least one tear line dividing the carton into a first portion and a second portion. The first portion configured to be pivotable at the hinge between an open position allowing access to the interior and a closed position with the first portion at least partially overlapping the second portion.

One aspect of the disclosure is directed to a blank for forming a carton for containing a product. The blank comprises a plurality of panels, the plurality of panels comprises a front panel, a back panel, a first side panel and a second side panel. A tear away panel in at least one of the plurality of panels. A hinge in at least one of the plurality of panels and at least one tear line extending at least partially across at least one of the plurality of panels. The at least one tear line dividing blank into a first portion and a second portion. The first portion configured to be pivotable at the hinge between an open position and a closed position with the first portion at least partially overlapping the second portion when the blank is formed into a carton.

In another aspect, the disclosure is generally directed to a method of forming a carton for containing a product. The method comprises obtaining a blank comprising a plurality of panels. The plurality of panels comprises a front panel, a back panel, a first side panel, and a second side panel. A tear away panel is in at least one of the plurality of panels. A hinge is in at least one of the plurality of panels, and at least one tear line extends at least partially across at least one of the plurality of panels. The method comprises forming an interior of the carton at least partially defined by the plurality of panels. The method further comprises accessing the interior of the carton by separating the tear away panel from the carton. The method comprises tearing the carton along the at least one tear line to divide the carton into a first portion and a second portion and to form an open position of the carton. The method further comprises pivoting the first portion at the hinge to a closed position wherein the first portion at least partially overlaps the second portion.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

Cartons or packages according to the present disclosure can accommodate articles of numerous different shapes. For the purpose of illustration and not for the purpose of limiting the scope of the disclosure, the following detailed description describes articles at least partially disposed within the carton embodiments. In one embodiment, the articles held in the carton can be food products, but the articles could be other nonfood products without departing from the disclosure. In this specification, the terms "lower," "bottom," "upper", "top", "front", and "back" indicate orientations determined in relation to fully erected cartons.

Figure 1:
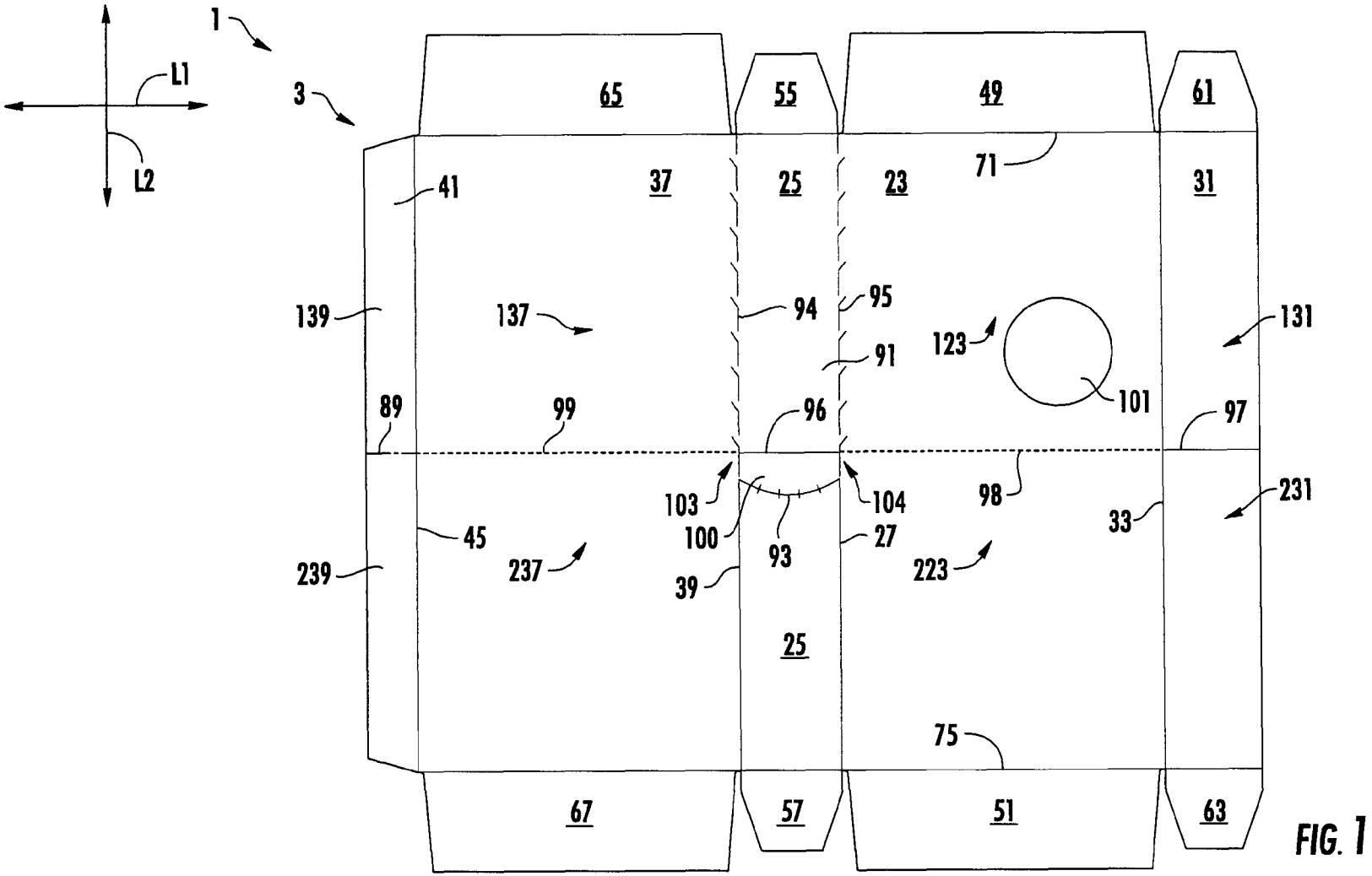
FIG. 1 is an exterior plan view of a blank used to form a carton in accordance with a first embodiment of the disclosure.

FIG. 1 is a plan view of an exterior surface 1 of a blank 3 used to form a carton 5 (FIG. 3) of a first embodiment of the disclosure. The carton 5 can be configured to hold articles (not shown) such as a plurality of food products (e.g., frozen food products, hamburgers, veggie burgers, waffles, or any other food product) or nonfood products, or any other suitable article or product within an interior 11 (FIG. 5) of the carton 5. The carton 5 can include various dispensing features and various opening/closing features without departing from the disclosure.

The blank 3 has a longitudinal axis L1 extending generally in the direction of the length of the blank and a lateral axis L2 extending generally in the direction of the width of the blank. The blank 3 includes a front panel 23 foldably connected to a first side panel 25 at a lateral fold line 27. A second side panel 31 is foldably connected to the front panel 23 at a lateral fold line 33. A back panel 37 is foldably connected to the first side panel 25 at a lateral fold line 39. An attachment flap 41 is foldably connected to the back panel 37 at a lateral fold line 45. Alternatively, the attachment flap 41 could be foldably connected to the second side panel 31.

Figure 3:
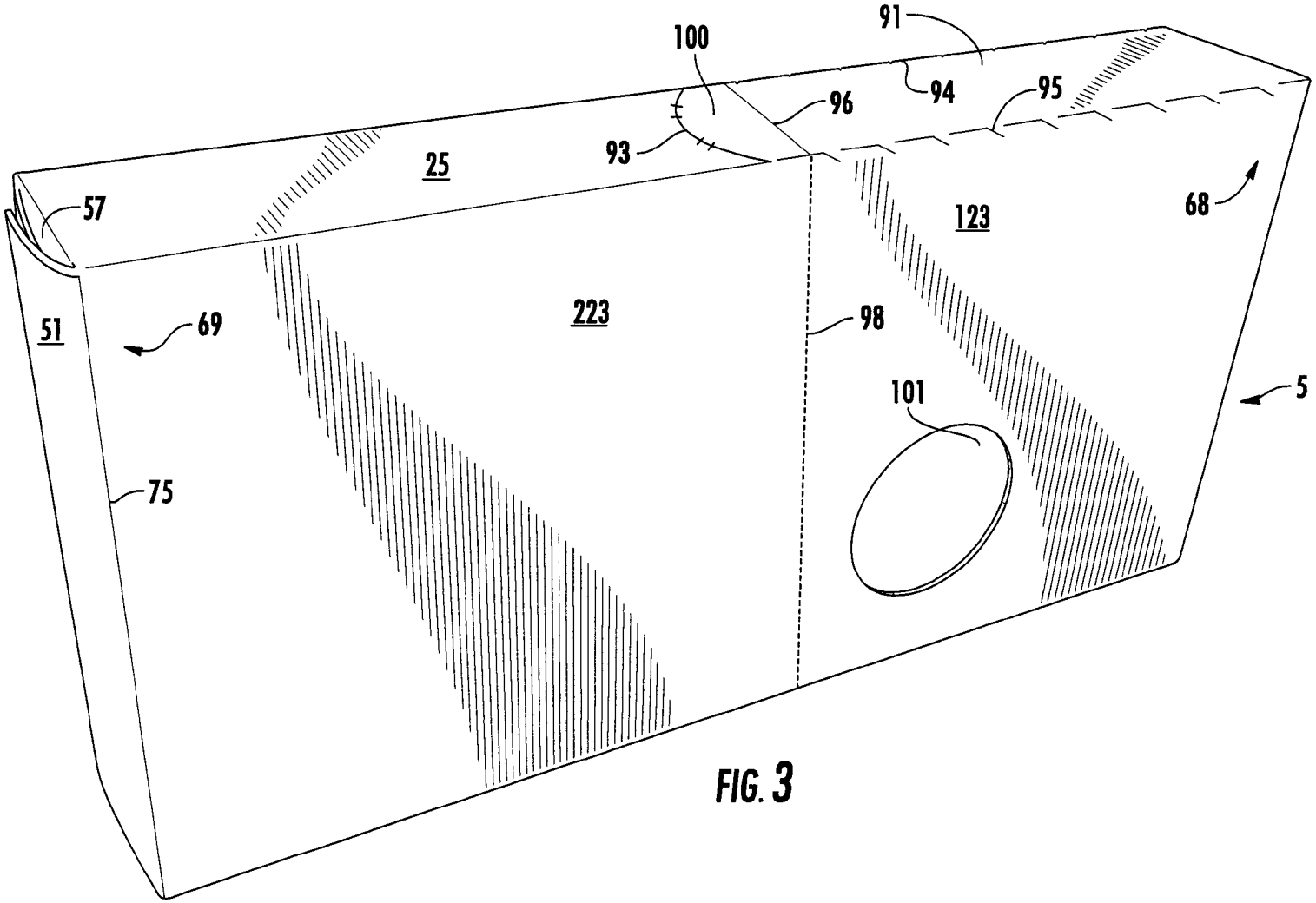
FIG. 3 is a front perspective view of the carton of FIG. 2 fully assembled.

In the illustrated embodiment, two end flaps 49, 51 are foldably connected to opposite ends of the front panel 23. Two end flaps 55, 57 are foldably connected to opposite ends of the first side panel 25. Two end flaps 61, 63 are foldably connected to opposite ends of the second side panel 31. Two end flaps 65, 67 are foldably connected to opposite ends of the back panel 37. When the carton 5 is erected, the end flaps 49, 55, 61, 65 close a first (e.g., top) end 68 of the carton, and the end flaps 51, 57, 63, 67 close a second (e.g., bottom) end 69 of the carton (FIG. 3). In accordance with an alternative embodiment of the present disclosure, different panel and flap arrangements can be used for closing the carton 5.

The end flaps 49, 55, 65 of the first end 68 extend along a first marginal area of the blank 3, and are foldably connected at a first longitudinal fold line 71 that extends along the length of the blank. The end flaps 51, 57, 63, 67 of the second end 69 extend along a second marginal area of the blank 3, and are foldably connected at a second longitudinal fold line 75 that extends along the length of the blank. The longitudinal fold lines 71, 75 may be, for example, substantially straight, or offset at one or more locations to account for blank thickness or for other factors. The end flaps 49, 55, 65, 51, 57, 63, 67 can be alternatively shaped, arranged, positioned, and/or omitted without departing from the disclosure.

Figure 7:
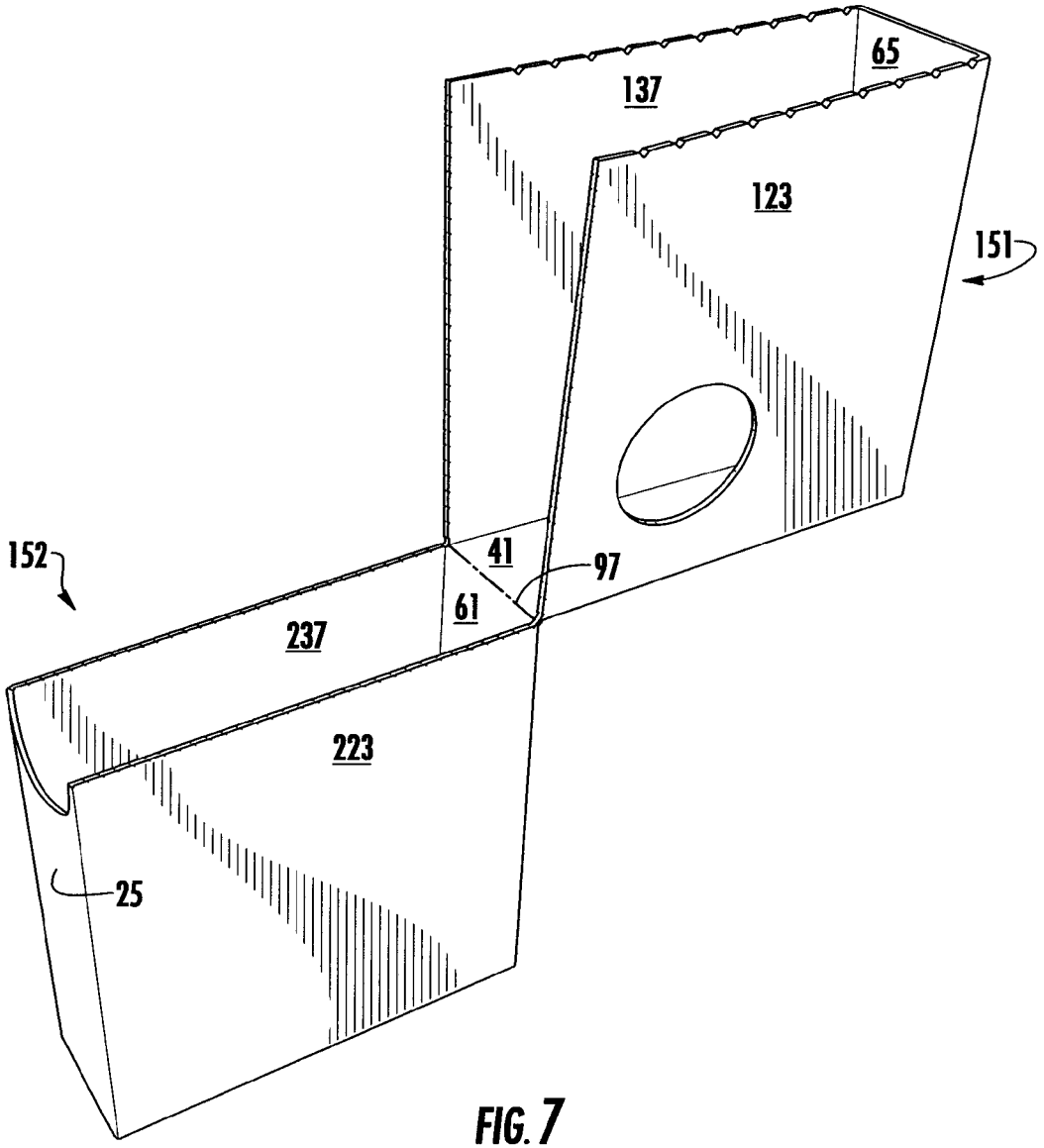
Figure 8:
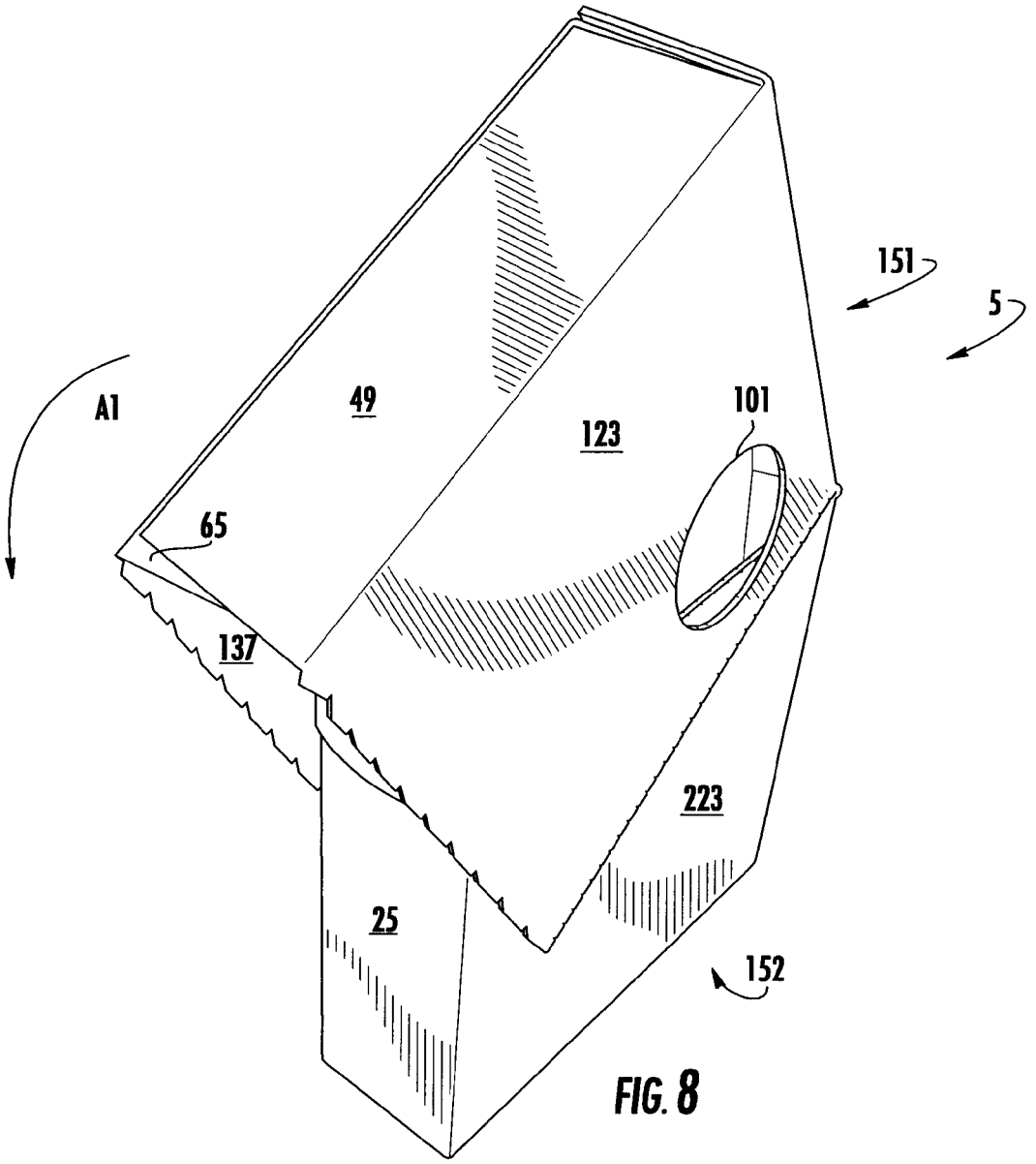
FIG. 8 is a perspective view of carton in the semi-closed configuration.

As shown in FIG. 1, a tear away panel 91 is formed from a portion of the first side panel 25. The tear away panel 91 is defined by two lateral tear lines 94, 95 extending from and collinear with the fold lines 39, 27, and an opening feature 93. The opening feature 93 may be an arcuate cut line extending between the front and back panels. The opening feature 93 may have a first end and a second end adjacent the respective two lateral tear lines 94, 95. A tab 100 for gripping and pulling the tear away panel may be defined by the opening feature 93, the two lateral tear lines 94, 95, and a longitudinal fold line 96 extending between the front panel 23 and the back panel 37. When formed into a carton, features 93, 94, 95, and 96 allow removal of the panel 91 and access to the interior of the carton. Furthermore, a fold line or hinge 97 extends across the second side panel 31, effectively dividing it into a first portion 131 and a second portion 231. Similarly, a longitudinal tear line 98 extends across the front panel 23, effectively dividing it into a first front portion 123 and a second front portion 223. Also, a longitudinal tear line 99 extends across the back panel 37, effectively dividing it into a first back portion 137 and a second back portion 237. A longitudinal line of weakening 89 extends across the attachment flap 41, effectively dividing it into a first attachment portion 139 and a second attachment portion 239. The line of weakening 89 may be a fold line or a tear line. Thus, upon tearing away the tear panel 91, the carton may effectively hinge about the fold line 97 and 89. In one embodiment the hinge 97, tear lines 98, 99 and longitudinal fold lines 96, 89 are all collinear. Window 101 on the front panel 23 may aid in viewing the interior of the carton and reopening a closed carton. As illustrated in FIG. 1, the window 101 may be in the first front portion 123, however, the window may be in another panel without departing from the disclosure. When reopening the closed carton, the window 101 may be used as a grip such that a finger may be inserted into the window 101 to move the carton 5 into the open position as shown in FIG. 7. The window 101 may be sustainably circular or any other shape. The opening and closing features and the associated features 89, 91, 93, 94, 95, 97, 98, 99, 101 may be otherwise shaped, arranged, and/or configured without departing from the scope of this disclosure.

Figure 2:
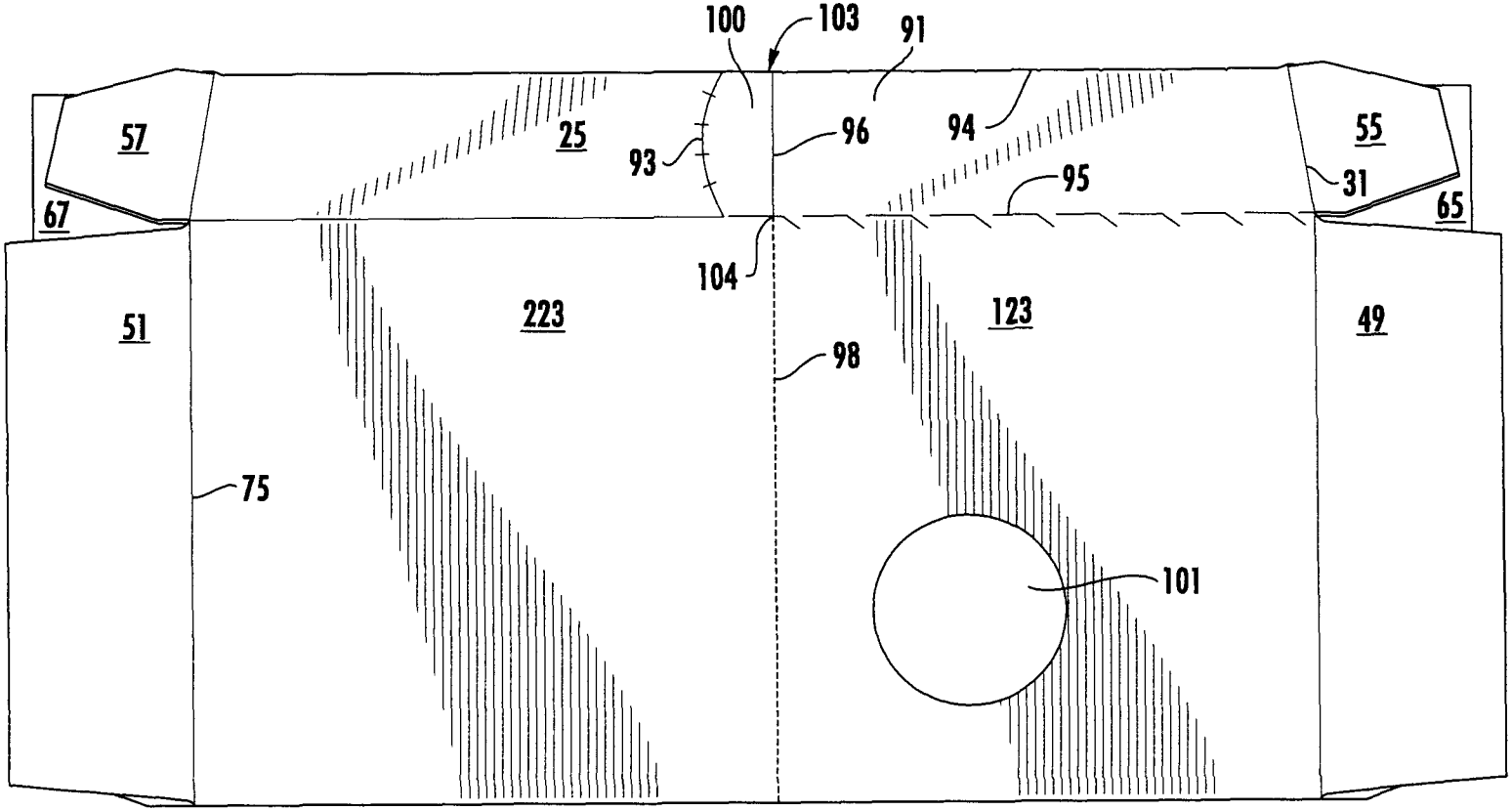
FIG. 2 is a top view of a carton in the flat configuration formed from the blank of FIG. 1.

As shown in FIGS. 2-12, and described in the following in accordance with one acceptable example, the carton 5 is formed from the blank 3 by folding panels 23, 25, 31, and 37 to at least partially form an interior 11 of the carton 5, for example, by creation of a sleeve (FIG. 2). Attachment flap 41 may receive adhesive or glue and may be affixed to an interior surface of the second side panel 31. Upon formation of the sleeve, the ends 68, 69 of the carton 5 may be closed by inwardly folding and attaching end flaps 49, 55, 61, 65 and 51, 57, 63, 67, respectively. The end flaps 49, 55, 61, 65 and 51, 57, 63, 67 may be attached with glue in some embodiments. The carton may be filled with products to be held therein during any suitable portion of carton formation, for example, through inclusion of a filled liner or multiple filled bags containing a food product.

Figure 4:
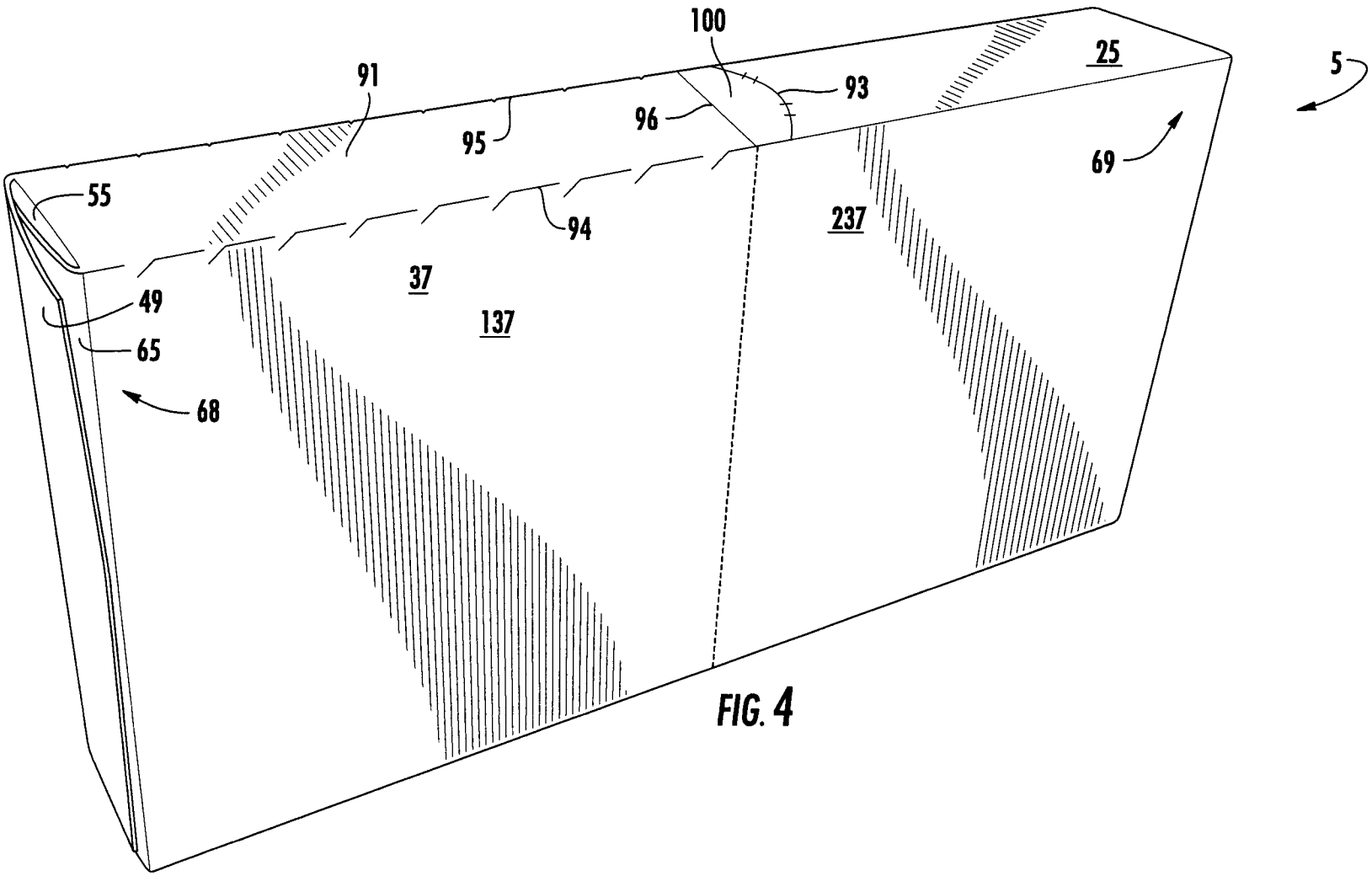
FIG. 4 is a back perspective view of the carton fully assembled.
Figure 5:
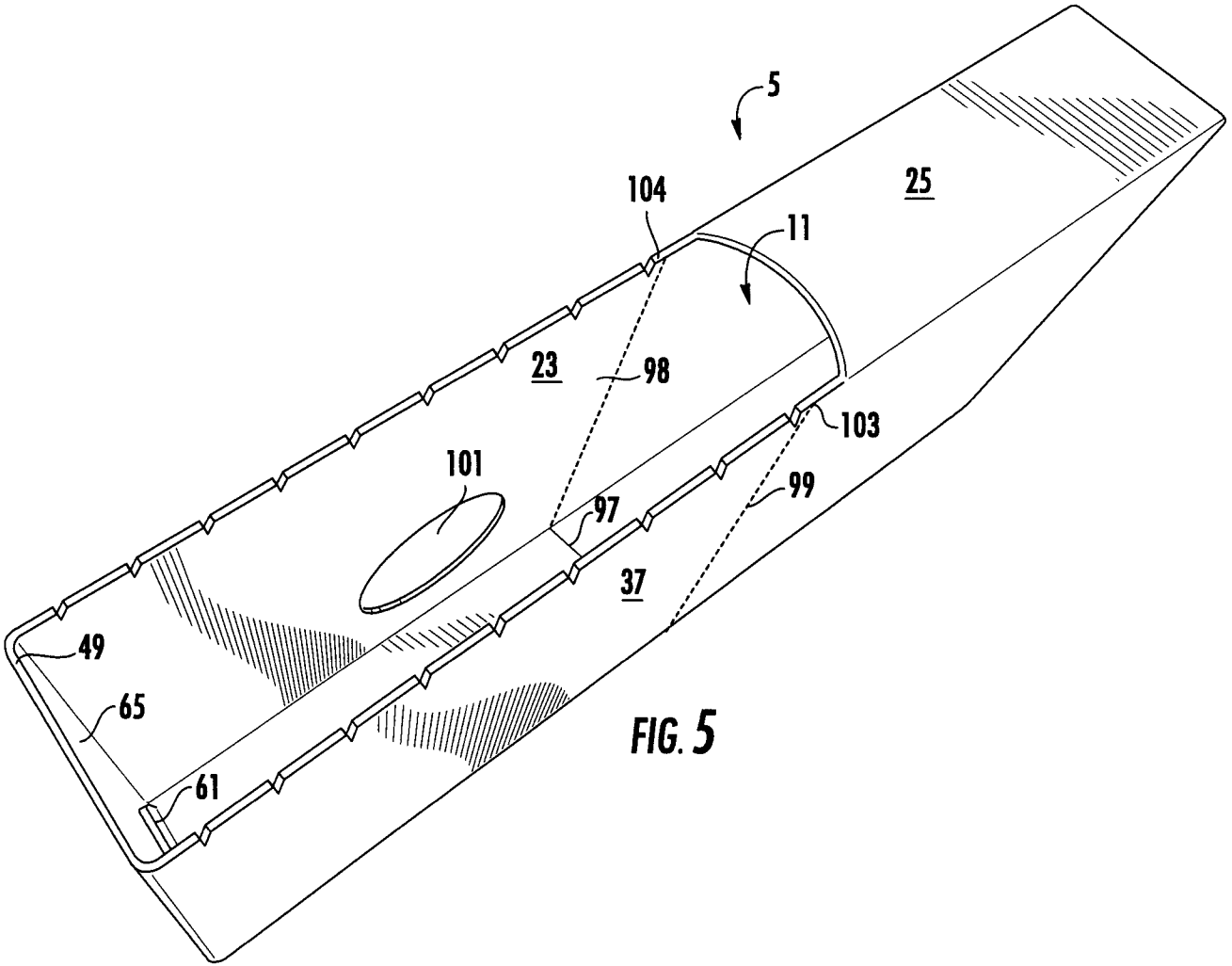
FIG. 5 is a top perspective view of the carton with a tear strip removed.
Figure 6:
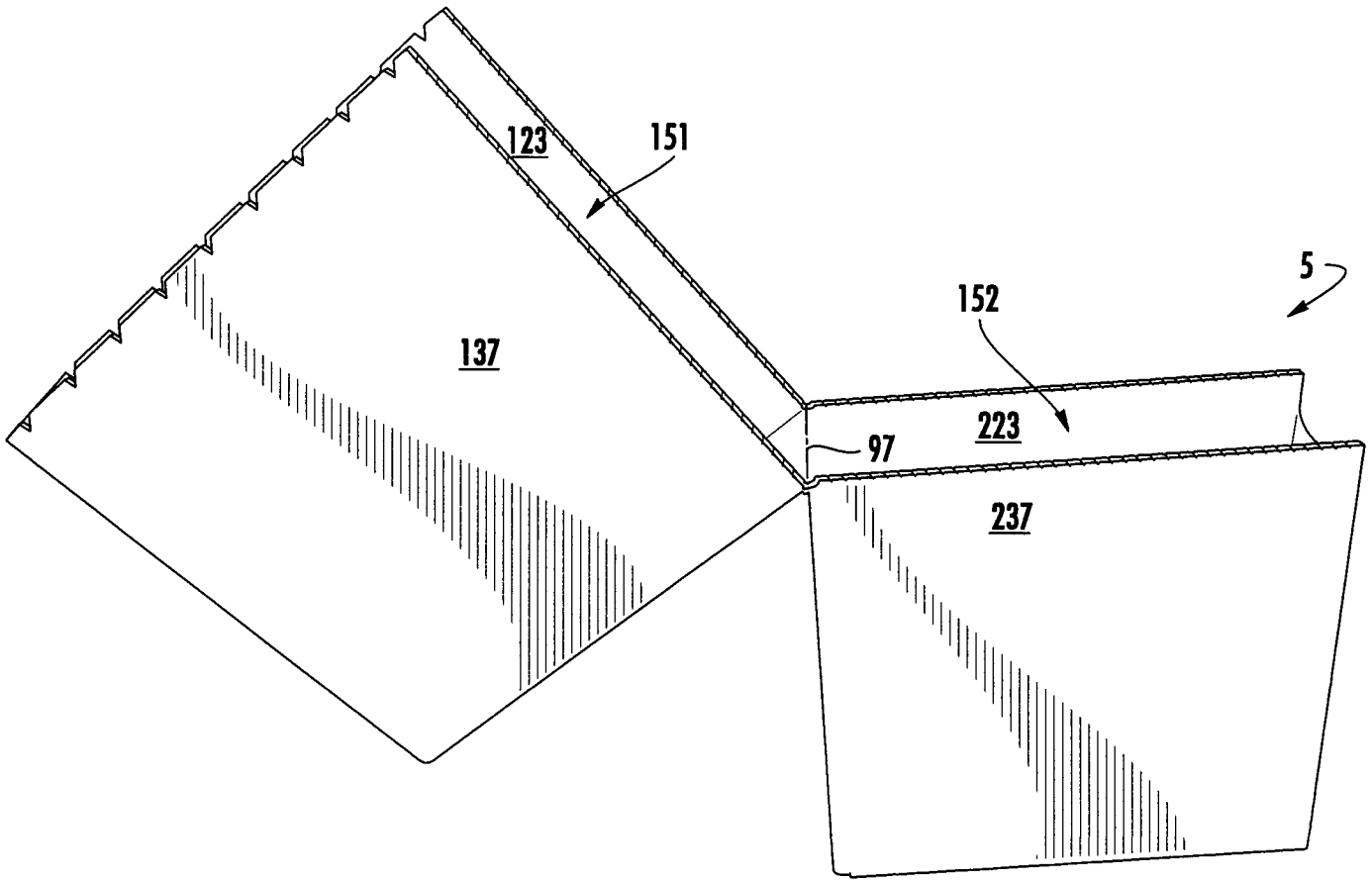
FIGS. 6-7 are perspective views of carton in the open configuration.
Figure 9:
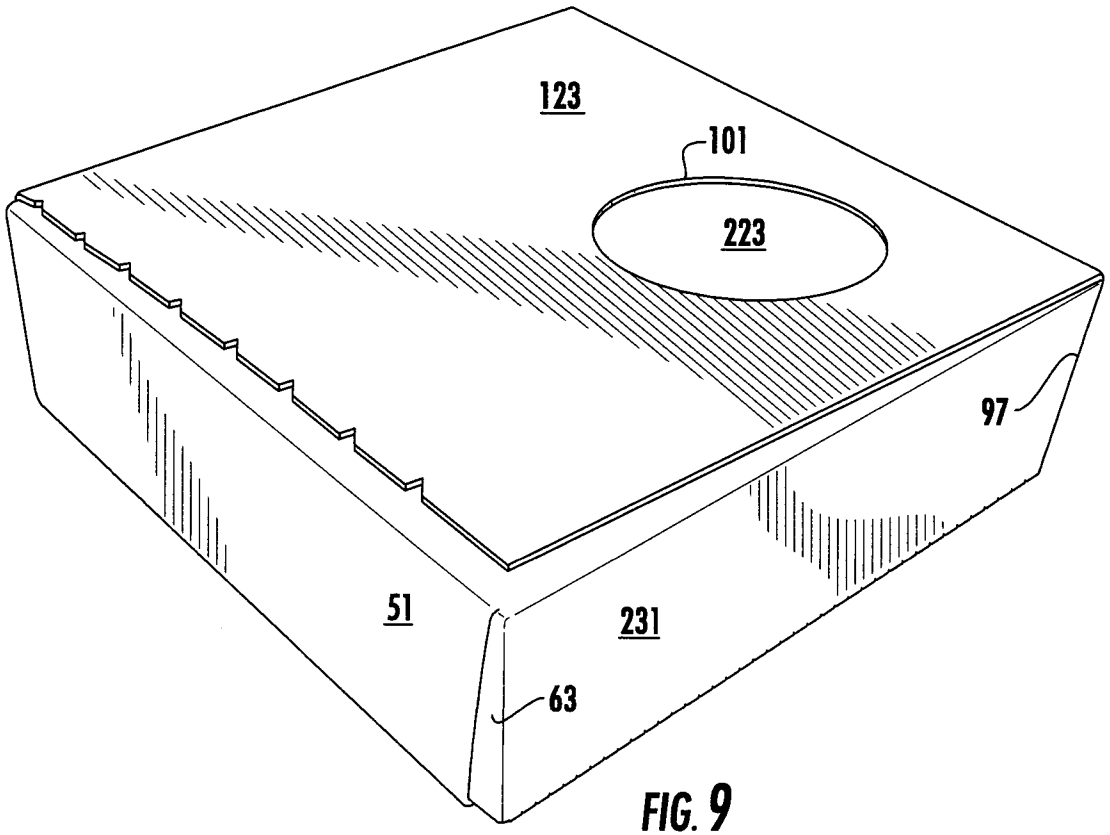
FIGS. 9-10 are perspective views of the carton in the closed configuration.
Figure 10:
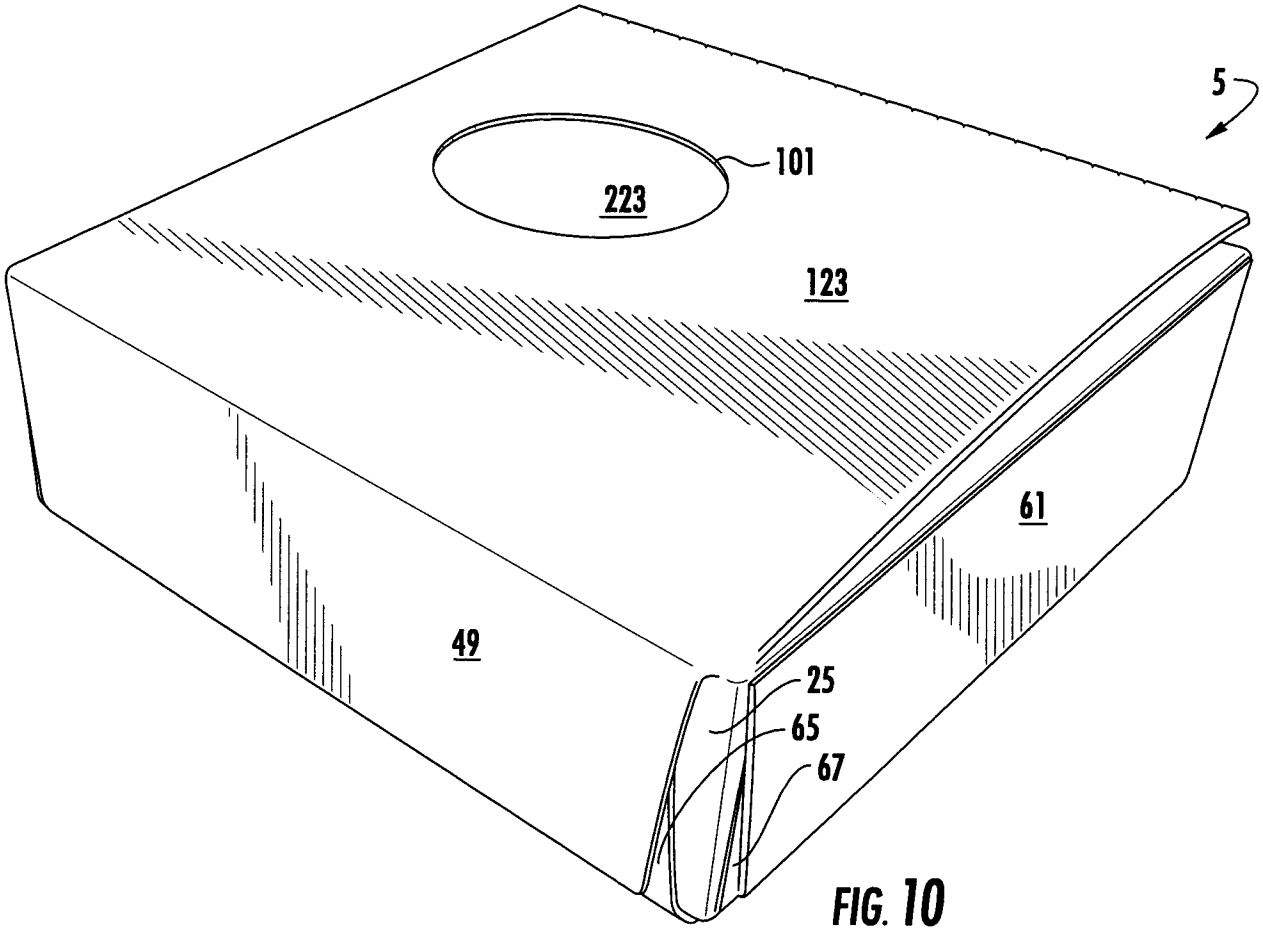
Figure 11:
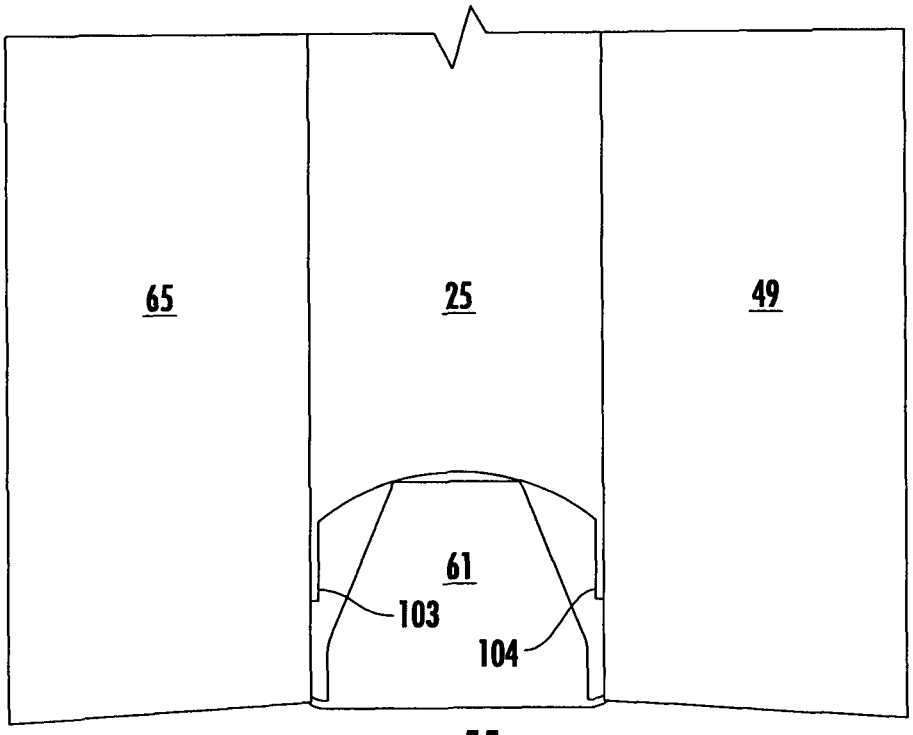
FIGS. 11-12 are perspective views of the corner of the carton illustrating the recloseable features in the closed configuration.
Figure 12:
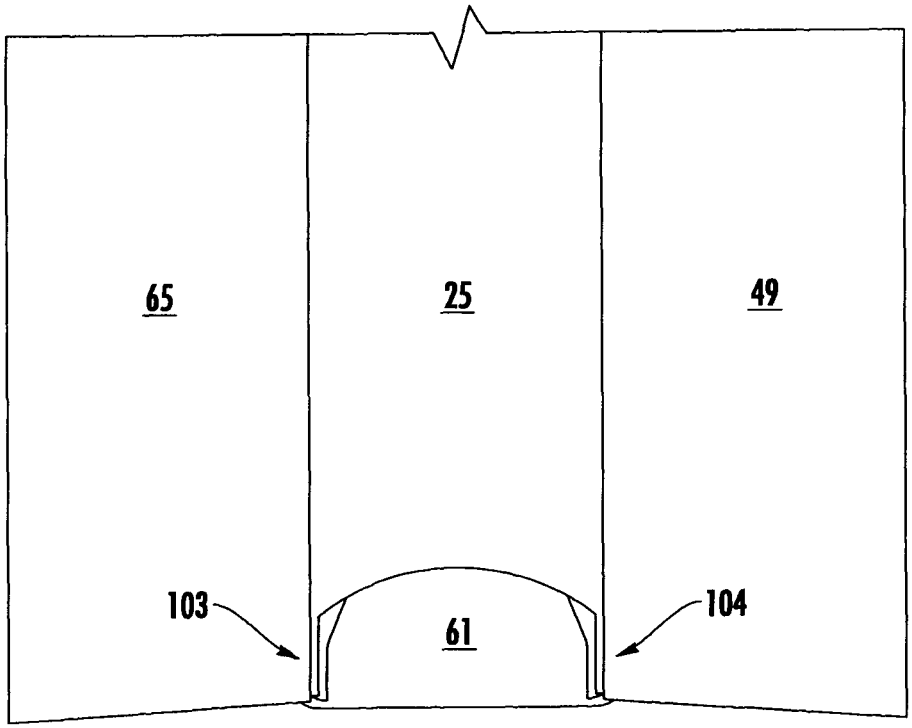

As shown in FIG. 4, the carton 5 may be initially opened by sliding an object (e.g., a finger) into the opening feature 93 to detach and lift the tab portion 100 and pull away tear panel 91 by tearing at tear lines 94, 95. Thereafter, as shown in FIG. 5, the interior 11 of the carton 5 may be accessed. After the contents of the carton have been partially exhausted, the carton may be configured to hinge about fold line 97 as shown in FIG. 6, by tearing at tear lines 98, 99 to separate portions 123, 223 and to separate portions 137, 237, respectively. To re-close the carton 5 (FIGS. 6-9), a first half or portion 151 of the carton may be pivoted about fold line 97 towards a second half or portion 152 of the carton in the direction of arrow A1 of FIG. 8. As shown in FIG. 9-10, the closed carton 5 is of a reduced size compared to the open carton of FIG. 3. Interior space in the closed position approximates half the size as the interior space in open position. As such, upon use or partial use of the contents of the carton, the carton may be closed to conserve space. To aid in maintaining closure of the carton once closed, corner regions 103, 104 of the panels 223, 237, respectively, may engage complementary corner regions within the interior 11 of the carton adjacent the end flap 61, as shown in FIGS. 11-12. Furthermore, while engaging the corner regions 103, 104, end flap 61 may in some embodiments be guided beneath panel 25 (e.g., towards the interior of the carton) further aiding in maintaining closure. Thus, the end flap 61 acts as a retention feature in the first portion 151 of the carton to retain the carton in the closed position.

Alternative assembling, loading, closing, opening, re-closing, and/or re-opening steps may be used without departing from the scope of the disclosure. For example, the sleeve can be loaded and closed in an automated process, and the ends 68, 69 can be partially closed. Additionally, the carton 5 could be otherwise shaped, arranged, and/or configured without departing from the disclosure. The carton 5 could include various handle features for carrying the carton and could include various dispenser features for opening the carton in manners not herein described. Further the carton 5 could include other panel/flap closing configurations without departing from the disclosure.

The carton 5 has been shown and described by way of example. Any of the features of the various embodiments of the disclosure can be combined with, replaced by, or otherwise configured with other features of other embodiments of the disclosure without departing from the scope of this disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, kraft lined paperboard, double kraft lined paperboard, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a product, the carton comprising:

a plurality of panels that extends at least partially around an interior of the carton, the plurality of panels comprises a front panel, a back panel, a first side panel and a second side panel;

a tear away panel in at least one of the plurality of panels, the tear away panel providing access to the interior;

a hinge in at least one of the plurality of panels;

at least one tear line extending at least partially across at least one of the plurality of panels, the at least one tear line dividing the carton into a first portion and a second portion, the first portion configured to be pivotable at the hinge between an open position allowing access to the interior and a closed position preventing access to the interior, the first portion at least partially overlapping the second portion in the closed position.

2. The carton of claim 1, wherein the hinge is collinear with the at least one tear line.

3. The carton of claim 2, wherein the hinge extends across the second side panel dividing the second side panel into a first portion and a second portion, the first portion of the carton includes the first portion of the second side panel and the second portion of the carton includes the second portion of the second side panel.

4. The carton of claim 1, wherein the at least one tear line comprises:

a first longitudinal tear line extending across the front panel dividing the front panel into a first front portion and a second front portion; and a second longitudinal tear line extending across the back panel dividing the back panel into a first back portion and a second back portion, the first portion of the carton comprises the first front portion and the first back portion, and the second portion of the carton comprises the second front portion and the second back portion.

5. The carton of claim 4 wherein the hinge, the first longitudinal tear line, and the second longitudinal tear line are collinear.

6. The carton of claim 1, wherein the carton further comprises a first end and a second end, a plurality of end flaps are foldably attached to respective panels of the plurality of panels, the plurality of end flaps close the first end and the second end.

7. The carton of claim 6, wherein one of the end flaps is configured to form a retention feature of the first portion of the carton, the retention feature engages an edge of the second portion of the carton to retain the carton in the closed position.

8. The carton of claim 1, wherein the interior of the carton has a first size in the open position and the interior of the carton has a second size in the closed position, the second size being less than the first size.

9. The carton of claim 8, wherein the second size is approximately half the first size.

10. A carton for containing a product, the carton comprising:

a plurality of panels that extends at least partially around an interior of the carton, the plurality of panels comprises a front panel, a back panel, a first side panel and a second side panel;

a tear away panel in at least one of the plurality of panels, the tear away panel providing access to the interior;

a hinge in at least one of the plurality of panels;

at least one tear line extending at least partially across at least one of the plurality of panels, the at least one tear line dividing the carton into a first portion and a second portion, the first portion configured to be pivotable at the hinge between an open position allowing access to the interior and a closed position with the first portion at least partially overlapping the second portion, wherein the tear away panel comprises an opening feature in the first side panel configured for detaching and pulling away the tear away panel to access the interior of the carton.

11. The carton of claim 10, wherein the opening feature comprises a tab at one end of the tear away panel defined by a cut and a fold line in the at least one plurality of panels.

12. The carton of claim 11, wherein the fold line is collinear with the at least one tear line.

13. A carton for containing a product, the carton comprising:

a plurality of panels that extends at least partially around an interior of the carton, the plurality of panels comprises a front panel, a back panel, a first side panel and a second side panel;

a tear away panel in at least one of the plurality of panels, the tear away panel providing access to the interior;

a hinge in at least one of the plurality of panels;

at least one tear line extending at least partially across at least one of the plurality of panels, the at least one tear line dividing the carton into a first portion and a second portion, the first portion configured to be pivotable at the hinge between an open position allowing access to the interior and a closed position with the first portion at least partially overlapping the second portion, wherein the tear away panel is in the first side panel and defined at least partially by a first lateral tear line and a second lateral tear line.

14. The carton of claim 13, wherein the front panel is foldably connected to the first side panel along a first fold line, the back panel is foldably connected to the first side panel along a second fold line, the first lateral tear line is collinear with the first fold line and the second lateral tear line is collinear with the second fold line.

15. The carton of claim 14, wherein the front panel comprises a window to view the interior of the carton.

16. A blank for forming a carton for containing a product, the blank comprising:

a plurality of panels, the plurality of panels comprises a front panel, a back panel, a first side panel and a second side panel;

a tear away panel in at least one of the plurality of panels, a hinge in at least one of the plurality of panels;

at least one tear line extending at least partially across at least one of the plurality of panels, the at least one tear line dividing the blank into a first portion and a second portion, the first portion configured to be pivotable at the hinge between an open position and a closed position preventing access to an interior of the carton, the first portion at least partially overlapping the second portion in the closed position when the blank is formed into a carton.

17. The blank of claim 16, wherein the hinge is collinear with the at least one tear line.

18. The blank of claim 17, wherein the hinge extends across the second side panel dividing the second side panel into a first portion and a second portion, the first portion of the carton includes the first portion of the second side panel and the second portion of the carton includes the second portion of the second side panel.

19. The blank of claim 16, wherein the at least one tear line comprises:

a first longitudinal tear line extending across the front panel dividing the front panel into a first front portion and a second front portion; and a second longitudinal tear line extending across the back panel dividing the back panel into a first back portion and a second back portion, the first portion of the blank comprises the first front portion and the first back portion, and the second portion of the blank comprises the second front portion and the second back portion.

20. The blank of claim 19, wherein the hinge, the first longitudinal tear line, and the second longitudinal tear line are collinear.

21. The blank of claim 16, wherein the blank further comprises a first end and a second end, a plurality of end flaps are foldably attached to respective panels of the plurality of panels, the plurality of end flaps are configured to close the first end and the second end when the blank is formed into a carton.

22. The blank of claim 21, wherein one of the end flaps is configured to form a retention feature of the first portion when the blank is formed into a carton, the retention feature engages an edge of the second portion to retain the carton in the closed position when the blank is formed into a carton.

23. A blank for forming a carton for containing a product, the blank comprising:

a plurality of panels, the plurality of panels comprises a front panel, a back panel, a first side panel and a second side panel;

a tear away panel in at least one of the plurality of panels, a hinge in at least one of the plurality of panels;

at least one tear line extending at least partially across at least one of the plurality of panels, the at least one tear line dividing the blank into a first portion and a second portion, the first portion configured to be pivotable at the hinge between an open position and a closed position with the first portion at least partially overlapping the second portion when the blank is formed into a carton, wherein the tear away panel comprises an opening feature in the first side panel configured for detaching and pulling away the tear away panel to access the interior when the carton is formed from the blank.

24. The blank of claim 23, wherein the opening feature comprises a tab at one end of the tear away panel defined by a cut and a fold line in the at least one plurality of panels.

25. The blank of claim 24, wherein the fold line is collinear with the at least one tear line.

26. A blank for forming a carton for containing a product, the blank comprising:

a plurality of panels, the plurality of panels comprises a front panel, a back panel, a first side panel and a second side panel;

a tear away panel in the first side panel and defined at least partially by a first lateral tear line and a second lateral tear line;

a hinge in at least one of the plurality of panels;

at least one tear line extending at least partially across at least one of the plurality of panels, the at least one tear line dividing the blank into a first portion and a second portion, the first portion configured to be pivotable at the hinge between an open position and a closed position with the first portion at least partially overlapping the second portion when the blank is formed into a carton.

27. The blank of claim 26, wherein the front panel is foldably connected to the first side panel along a first fold line, the back panel is foldably connected to the first side panel along a second fold line, the first lateral tear line is collinear with the first fold line and the second lateral tear line is collinear with the second fold line.

28. The blank of claim 27, wherein the front panel comprises a window to view the interior of the carton.

29. A method of forming a carton for containing a product, the method comprising:

obtaining a blank comprising a plurality of panels, the plurality of panels comprises a front panel, a back panel, a first side panel, a second side panel, a tear away panel in at least one of the plurality of panels, a hinge in at least one of the plurality of panels, and at least one tear line extending at least partially across at least one of the plurality of panels;

forming an interior of the carton at least partially defined by the plurality of panels;

accessing the interior of the carton by separating the tear away panel from the carton; and tearing the carton along the at least one tear line to divide the carton into a first portion and a second portion and form an open position of the carton;

pivoting the first portion at the hinge to a closed position wherein the first portion at least partially overlaps the second portion preventing access to the interior.

30. The method of claim 29, wherein the tear away panel comprises an opening feature in the first side panel configured for detaching and pulling away the tear away panel to access the interior of the carton.

31. The method of claim 29, wherein the forming the interior comprises forming the interior with a first size at the open position, the pivoting the first portion comprises reducing the interior to a second size that is less than the first size.

32. The method of claim 31, further comprising removing a food product prior to the pivoting the first portion to the closed position.

33. A method of forming a carton for containing a product, the method comprising:

obtaining a blank comprising a plurality of panels, the plurality of panels comprises a front panel, a back panel, a first side panel, a second side panel, a tear away panel, a hinge in at least one of the plurality of panels, and at least one tear line extending at least partially across at least one of the plurality of panels, wherein the tear away panel comprises an opening feature in the first side panel configured for detaching and pulling away the tear away panel to access the interior of the carton, the tear away panel is in the first side panel and defined at least partially by a first lateral tear line and a second lateral tear line;

forming an interior of the carton at least partially defined by the plurality of panels;

accessing the interior of the carton by separating the tear away panel from the carton; and tearing the carton along the at least one tear line to divide the carton into a first portion and a second portion and form an open position of the carton;

pivoting the first portion at the hinge to a closed position wherein the first portion at least partially overlaps the second portion.

34. The method of claim 33, wherein the front panel is foldably connected to the first side panel along a first fold line, the back panel is foldably connected to the first side panel along a second fold line, the first lateral tear line is collinear with the first fold line and the second lateral tear line is collinear with the second fold line.

35. The method of claim 34, wherein the at least one tear line comprises:

a first longitudinal tear line extending across the front panel dividing the front panel into a first front portion and a second front portion; and a second longitudinal tear line extending across the back panel dividing the back panel into a first back portion and a second back portion, the first portion of the carton comprises the first front portion and the first back portion, and the second portion of the carton comprises the second front portion and the second back portion.

36. The method of claim 35 wherein the carton further comprises a first end and a second end, a plurality of end flaps are foldably attached to respective panels of the plurality of panels, the plurality of end flaps close the first end and the second end; one of the end flaps is configured to form a retention feature of the first portion of the carton, the retention feature engages an edge of the second portion of the carton to retain the carton in the closed position; the carton further comprises an attachment flap foldably connected to the back panel.

37. The method of claim 36 wherein the plurality of end flaps comprises:

a first end flap foldably connected the second side panel along a first edge.

* * * * *